US006004168A

United States Patent [19]

Fuchs et al.

[11] Patent Number: 6,004,168

[45] Date of Patent: Dec. 21, 1999

[54] ELECTRICAL CONNECTOR FOR A PRINTED-CIRCUIT BOARD

[75] Inventors: Helmut Fuchs, Halver; Dirk Pellizari, Wuppertal, both of Germany

[73] Assignee: Karl Lumberg GmbH & Co., Schalksmuhle, Germany

[21] Appl. No.: 09/199,915

[22] Filed: Nov. 25, 1998

[30] Foreign Application Priority Data

Nov. 29, 1997 [DE] Germany ..... 197 53 076

[51] Int. Cl.[6] ..... H01R 4/48

[52] U.S. Cl. ..... 439/835; 439/828; 439/630; 439/834

[58] Field of Search ..... 439/835, 789, 439/828, 630, 834, 441, 260, 716

[56] References Cited

U.S. PATENT DOCUMENTS

| | | | |
|---|---|---|---|
| 3,648,220 | 3/1972 | Julinot | 439/80 |
| 4,082,407 | 4/1978 | Smorzaniuk et al. | 439/487 |
| 4,695,920 | 9/1987 | Klebba et al. | 439/806 |
| 5,895,286 | 4/1999 | Linke | 439/441 |
| 5,915,991 | 6/1999 | Roman | 439/441 |

FOREIGN PATENT DOCUMENTS

| | | | |
|---|---|---|---|
| 38 17 706 | 12/1988 | Germany . | |
| 37 10 394 | 8/1990 | Germany . | |
| 35 14 099 | 11/1994 | Germany . | |
| 35 14 097 | 12/1996 | Germany . | |
| 196 11 762 | 10/1997 | Germany . | |
| 0050992 | 4/1979 | Japan | 439/441 |

*Primary Examiner*—Paula Bradley
*Assistant Examiner*—Tho D. Ta
*Attorney, Agent, or Firm*—Herbert Dubno; Andrew Wilford

[57] ABSTRACT

A connector has a housing formed with a cavity, with a slot extending from the cavity, adapted to receive an edge of a circuit board, and having a width substantially greater than the circuit-board width, and with a hole opening outward from the cavity and adapted to receive the wire. A conductive rocker in the cavity has a front arm extending out of the cavity through the slot, a rear arm in the cavity adjacent the hole, and a central pivot bump between the ends of the rocker. A spring in the cavity engaging the pivot pin presses the rocker laterally across the slot with the rocker front arm bearing on the strip of the board received in the slot and presses the wire received in the hole against the rocker rear arm.

15 Claims, 4 Drawing Sheets

12
17
18
42
11
21
10
15
23
13
R
19
27
R
22
24
20
34
33
30
Bmax
14
16
Q
31
26
37
28
32
11
29
25

13
40
11
17
43
12
18
21
15
20
10
23
34
22
α
III
25
33
24
III
R
30
19
27
Q
29
28
26
14
31
32
37
Bmin
16
a
b

ELECTRICAL CONNECTOR FOR A PRINTED-CIRCUIT BOARD

FIELD OF THE INVENTION

The present invention relates to an electrical connector. More particularly this invention concerns a connector used to electrically connect a wire or the like to a printed conductor on the face of a printed-circuit board, particularly of the surface-mount-device (SMD) type.

BACKGROUND OF THE INVENTION

It is frequently necessary for input/output purposes, for example, to connect signal- and voltage-carrying wires to the conductors printed on the faces of printed-circuit boards. Typically this is done at the edge of the board where each printed conductor extends perpendicular to the edge as a thin strip.

In old-fashioned boards, not of the SMD type, the connector can be mounted on one face of the board as described in German 196 11 762 of Stadler. Here the connector has a pin that is pressed through a hole in the board and soldered in place and includes a seat for a wire end that can be clamped in place. In German 3,817,706 of Werk a clip is shown which engages through the board to press against both faces. This clip is elastically deformable to press a conductor of a wire against a face of the board. These systems are not usable in a system where contact must only be made with one face of the board, because the other face carries other conductors that must not be contacted.

The arrangement of German patent 3,710,394 of Eisert has a nonconducting housing that fits over an edge of the board in an exact fit and that has a tongue-like conductor engaging one face of the board. This arrangement only works with one size of board, and will not work at all if the board is slightly too thick or too thin as the mount will be sloppy and the conductor will not make adequate contact with the conductor on the face of the board.

In related art, German patents 3,514,099 and 3,514,097 of Hohorst show systems for joining two wires where a single resilient conductor strip can be elastically deformed such that when it is released it captures and presses together the conductors of two wires. This system is very convenient for solderless coupling of two wires, but is not readily adaptable for use with a printed-circuit board, much less an SMD board.

OBJECTS OF THE INVENTION

It is therefore an object of the present invention to provide an improved electrical connector for an SMD printed-circuit board.

Another object is the provision of such an improved electrical connector for an SMD printed-circuit board which overcomes the above-given disadvantages, that is which is of simple construction, which can be used with a variety of different boards of different thicknesses, and which forms a solid electrical connection between a conductive strip in the board and a wire.

SUMMARY OF THE INVENTION

A connector has according to the invention a housing formed with a cavity, with a slot extending from the cavity, adapted to receive an edge of a circuit board, and having a width substantially greater than the circuit-board width, and with a hole opening outward from the cavity and adapted to receive the wire. A conductive rocker in the cavity has a front arm extending out of the cavity through the slot, a rear arm in the cavity adjacent the hole, and a central pivot between the ends. A spring in the cavity engaging the pivot presses the rocker laterally across the slot with the rocker front arm bearing on the strip of the board received in the slot and presses the wire received in the hole against the rocker rear arm.

The slot can be made of a width substantially greater than the thickness of the thickest circuit board likely to be encountered, and the laterally movable and biased spring front arm can be counted on to make good contact with the conductive strip on the board engaged in the slot. Thus this system can be used on different types of boards. It nonetheless only engages with its housing, which is dielectric, on the opposite face of the board so it can be used on sensitive SMD boards. In addition the rocker can be made of a highly conductive material while the spring is made of a different material having greater elasticity.

In accordance with the invention the spring has one end bearing against the rocker at the pivot and an opposite other end engageable with the rocker rear arm. This other spring end is formed with a hole through which the rocker rear arm engages. The hole in the other spring end is aligned with the housing hole.

The housing according to the invention is formed in the cavity with a spring pivot engaging the spring between its ends. The spring is a leaf spring looped around the spring pivot and bears with its one spring end on the pivot and has its other spring end biased toward the rocker rear arm.

The rocker front arm is substantially longer than the rocker rear arm and the rocker is stiff and made of a conductive metal, normally brass. The rocker rear end is bent down and the housing is formed with an abutment aligned with the hole and engageable with the rocker rear end.

The housing is dielectric and the spring is wholly contained in the cavity. The rocker is contained in the cavity except for an outer end of its front arm. In addition the housing can have one face formed with mounting studs and an opposite face formed with complementary seats so that a plurality of the connectors can be ganged together with the studs of one housing engages in the seats of an adjacent housing. This housing is formed with a second hole offset from the first-mentioned hole and at which the spring is exposed so that a tool can be inserted in the second hole to displace the spring away from the rocker rear arm. Alternately a lever engaging the spring is pivotal on the housing between a position pressing the spring away from the wire received in the hole. This lever can be pressed to allow a wire to be inserted into or withdrawn from the wire hole.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
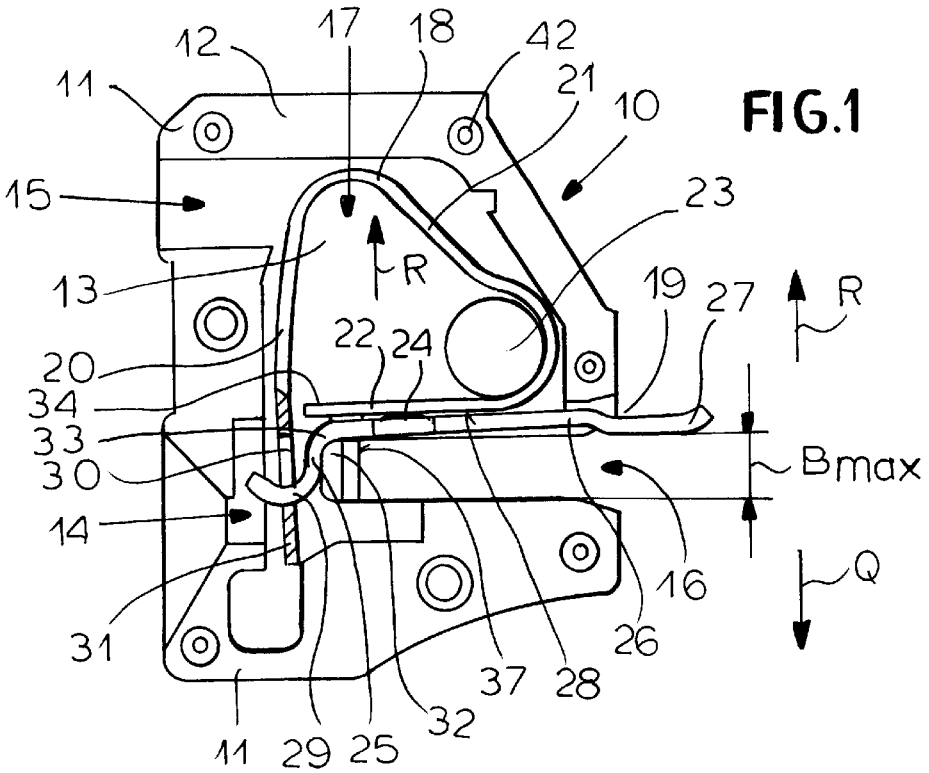
FIGS. 1 and 2 are side views of the connector according to the invention in different positions.
Figure 2:
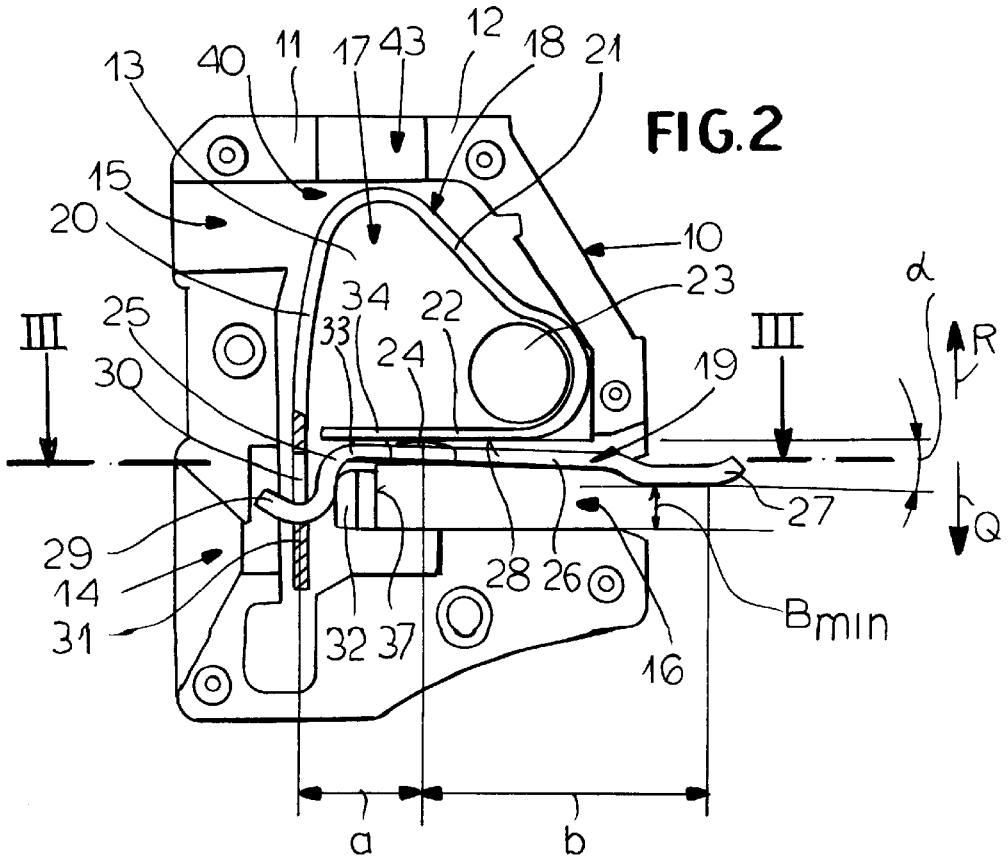
Figure 3:
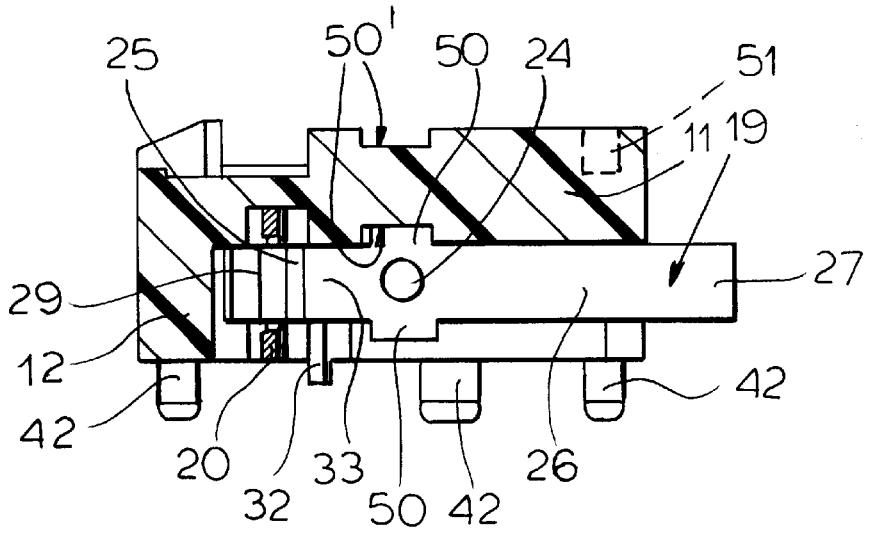
FIG. 3 is a section taken along line III—III of FIG. 3.
Figure 4:
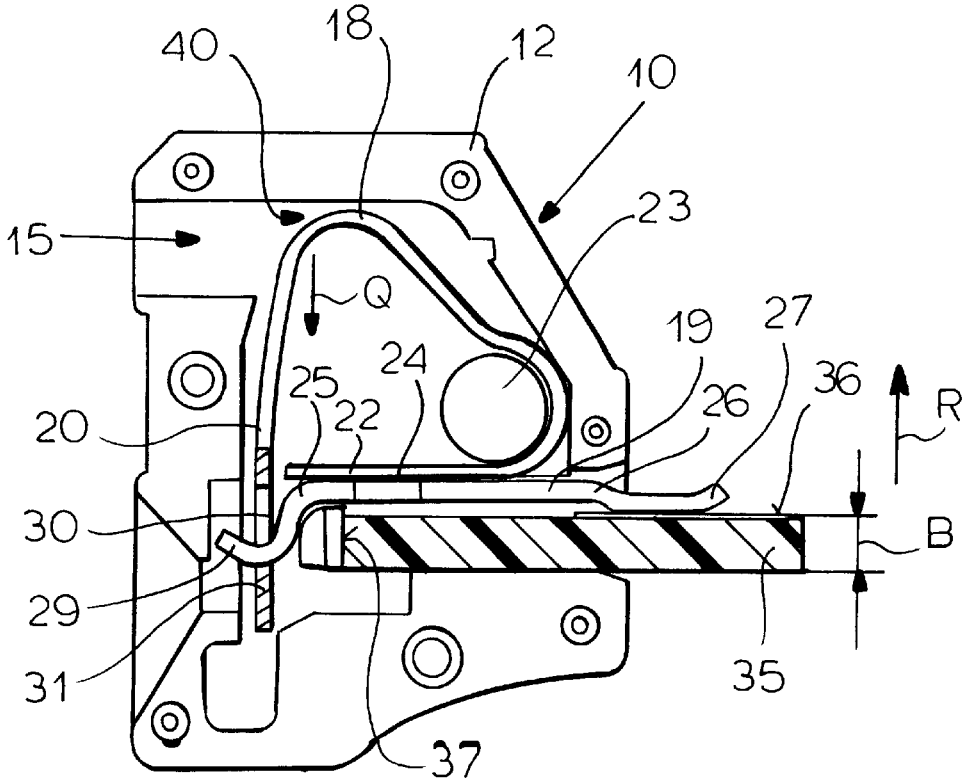
FIG. 4 is a side view of the connector fitted to a printed-circuit board.
Figure 5:
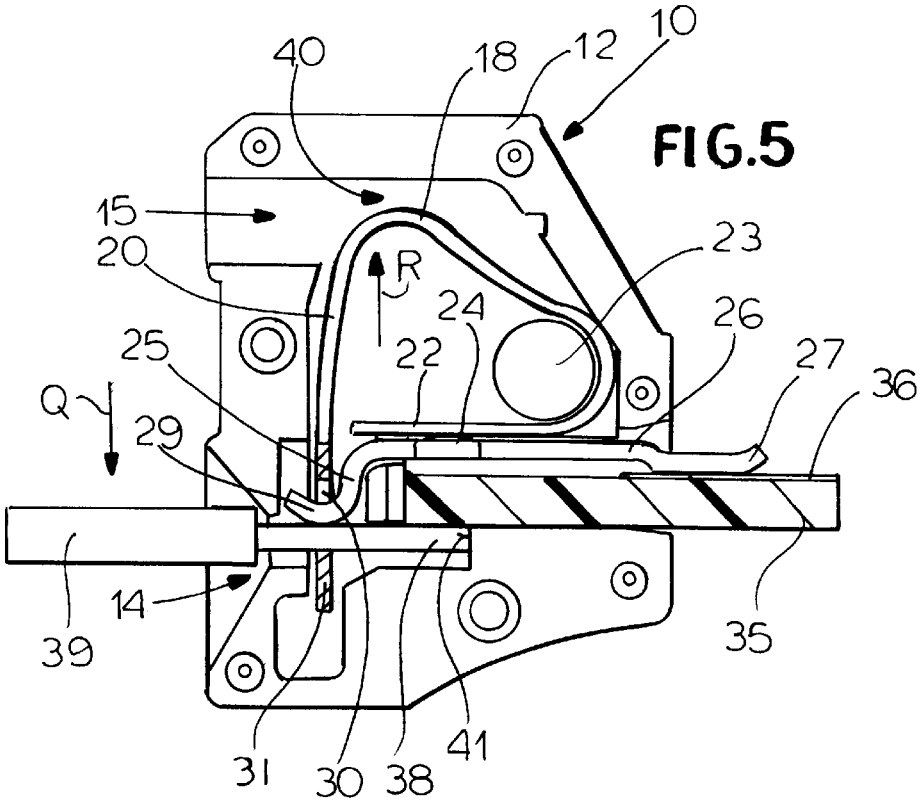
FIG. 5 is a side view of the connector fitted to a printed-circuit board and to a wire.

As seen in FIGS. 1 through 3 a connector 10 according to the invention has a dielectric housing 11 comprised of blocks 12 fixed to an end plate 13 together defining at one side a hole 14 for admission of a wire 39 (FIG. 5) and on the other side a slot 16 for admission of a circuit board 35 (FIGS. 4 and 5). Another hole 15 formed above the wire hole 14 serves for insertion of a tool as will be described below.

A cavity 17 of the housing 11 holds a spring-steel spring 18 having a rear arm 20 extending across the hole 14, a center portion 21, and a front arm 22 extending parallel to the slot 16. This spring 18 is wrapped around a pivot pin 23 projecting from the end plate 13.

A rocker 19 made of brass or other highly conductive metal has a center pivot or fulcrum bump 24 engaging upward against a lower face 28 of the arm 22 of the spring 18, a rear arm 25 extending back and bent down to project at an outer end 29 through a hole 30 in the spring arm 20, and a front arm 26 with an outer end 27 projecting out of the slot 16 of the housing 11. An outer end 31 of the spring arm 20 can engage upward against the bent-down outer end 29 of the rocker 19 which itself engages forward against an abutment 32 of the housing 11. The rear arm 25 has an effective relatively short length a measured from its point of contact with the spring 18 to the pivot bump 24, and the front arm 26 has a length b about three times as great, measured from the pivot bump 24 to the its outer end. In addition as shown in FIG. 3 the rocker 19 has level with the pivot bump 24 two lateral pivot tabs 50 engaged in recesses 50' of the end plate 13.

In FIG. 1 the outer rocker end 27 is shown pushed all the way up to define a gap having a maximum width $B_{max}$. In this position an upper face 33 of the rocker 19 rearward of the pivot bump 24 is out of engagement with the spring-arm end 34 but the rocker end 29 remains in engagement with the spring end 31.

FIG. 2 shows the connector 10 with the outer rocker end 27 all the way down in direction Q, forming a gap having a width $B_{min}$ in the slot 16. In this position the upper face 33 of the rocker rearward of the pivot bump 24 engages an extreme outer end 34 of the spring arm 22 and the extreme rear end 29 of the rocker 19 is still in engagement with the outer end 31 of the spring 18. This is thus the rest position of the structure. The end 34 of the spring 18 is urged upward somewhat in direction R. Here the adjustment range is shown at $\alpha$.

In use as shown in FIG. 4 the printed-circuit board 35, which has a width B that is more than $B_{min}$ and less than $B_{max}$, is inserted into the slot 16 until it engages an abutment face 37 at the end thereof. In this position the end 27 of the rocker 29 is resting on one of the conductive strips 36 of the board 35, where it may be soldered in place. The board 35 therefore cams up the outer arm end 27, ensuring good contact of this end 27 with the conductive strip 36.

Figure 7:
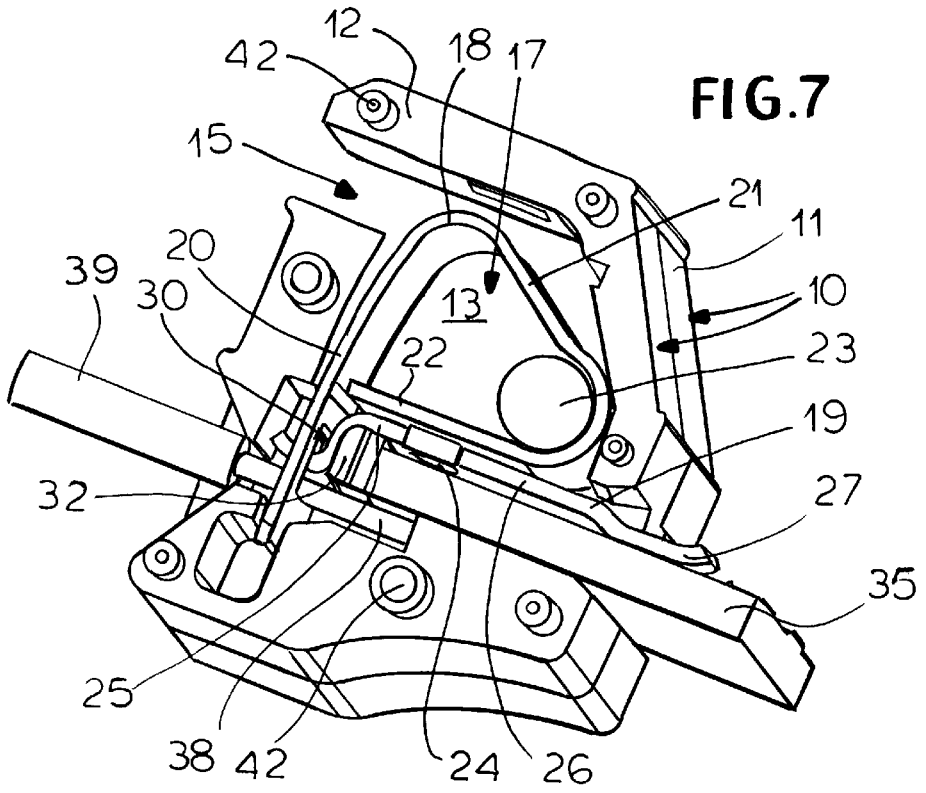
FIG. 7 is side view of the connector.

Then a tool is inserted into the hole 15 to fit in a gap 40 (FIG. 5) between the upper turn of the spring 18 and the housing block 12 to push the arm 20 down in direction Q so that its hole 30 aligns with the hole 14. The wires 39 is then inserted into this hole so its conductor 38 extends through the hole 39 and engages an abutment face 41 formed by the housing 11, then the tool is removed from the hole 15 so that spring 18 moves the arm 20 back up, pressing the wire conductor 38 tightly against the curved outer end 29 of the rocker 19. Like the slot 16, the hole 14 can accommodate heavy- and light-gauge conductors 14, forming a good connection between either and the rocker 19 whose other end is in good electrical contact with the printed-circuit strip 36 as also shown in FIG. 7.

Figure 6:
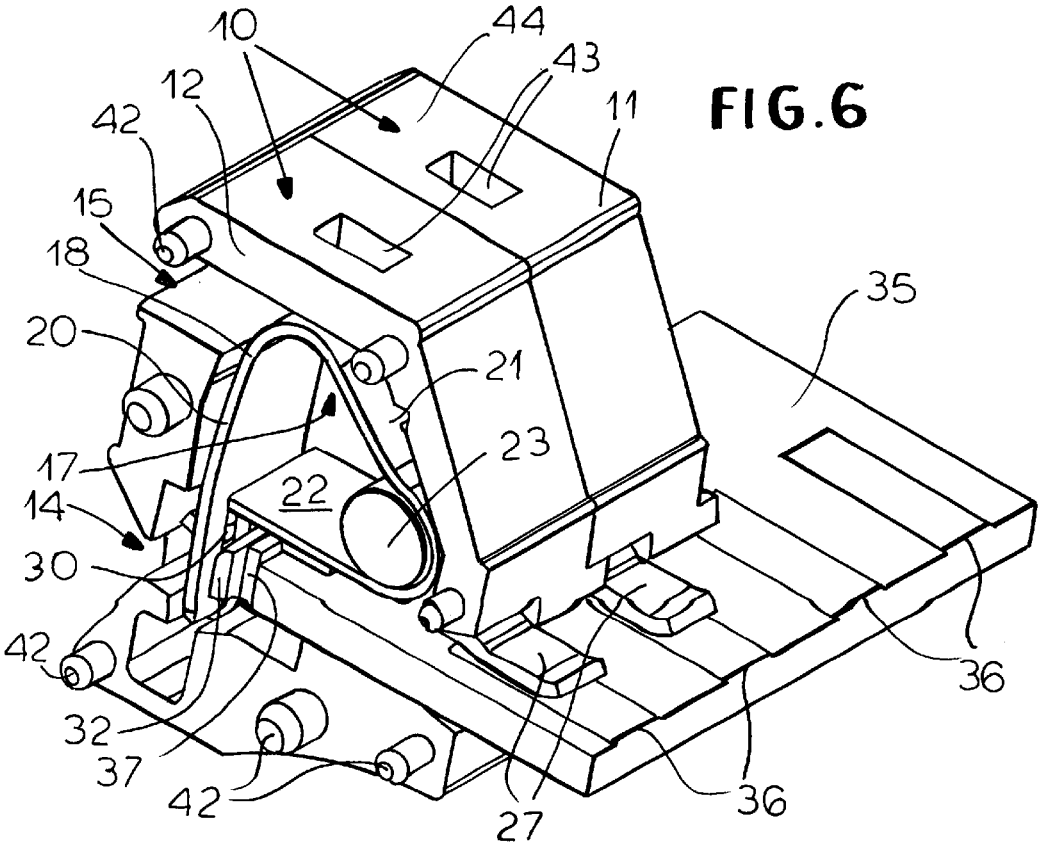
FIG. 6 is a perspective view of two connectors in accordance with the invention in a ganged arrangement.

FIG. 6 shows how two or more such connectors 10 can be ganged. To this end they have short connector pins 42 on their sides opposite the side plates 13 that engage in holes 51 (FIG. 3) on the opposite sides of the adjacent connectors 10. In addition holes 43 can be cut in upper surfaces 44 of the housings 11 to allow the springs 18 to be actuated from above as well as through the holes 15.

Figure 8:
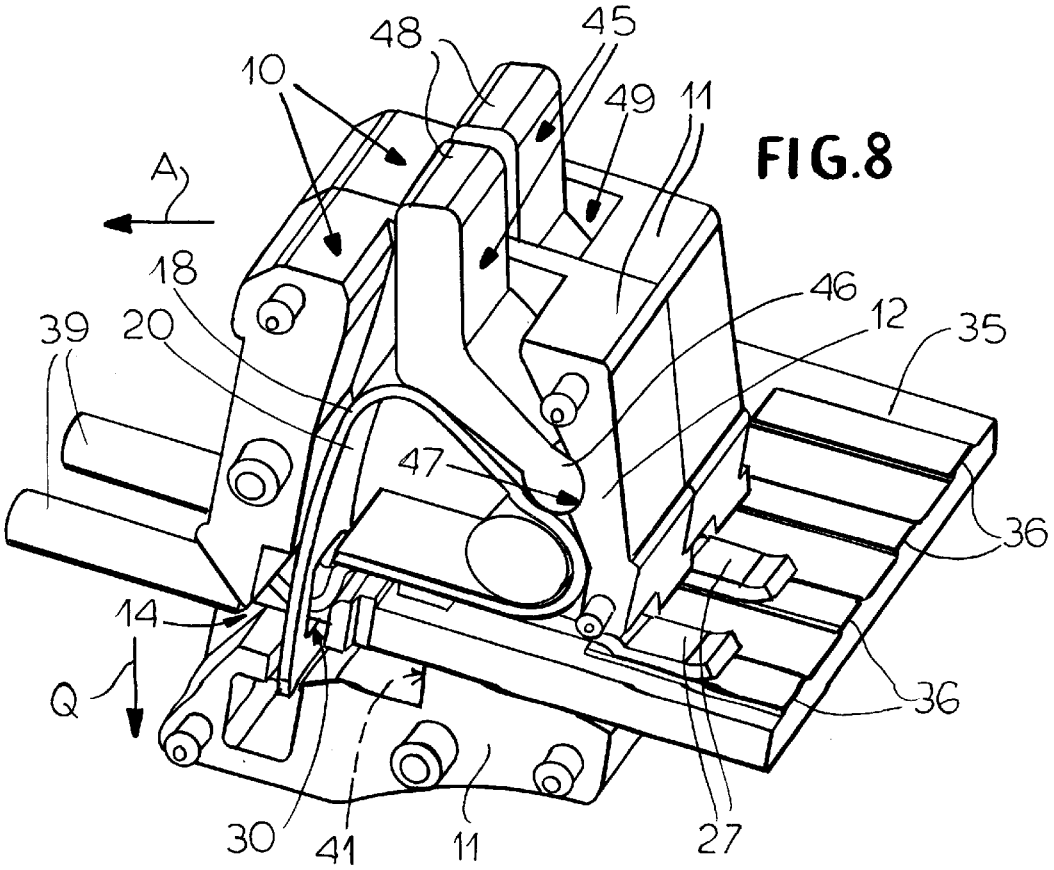
FIG. 8 is a perspective view of another ganged connector assembly according to the invention.

The arrangement of FIG. 8 has for each connector 10 an operating lever 45 with an actuating portion 48 extending through a hole 49 in the top of the connector 10 and pivoted at a lower end 46 in a seat 47 formed in the front wall of the housing 11. Thus pivoting of the lever 48 back as shown by arrow A will push down the spring arm 20 to allow a wire 39 to be inserted or removed.

We claim:

1. A connector for electrically connecting a wire to a conductive strip on a face of a printed-circuit board having a predetermined width, the connector comprising:

a housing formed with a cavity, a slot extending from the cavity, adapted to receive an edge of the circuit board, and having a width substantially greater than the circuit-board width, and a hole opening outward from the cavity and adapted to receive the wire;

a conductive rocker in the cavity having a front arm extending out of the cavity through the slot, a rear arm in the cavity adjacent the hole, and a central pivot bump between the ends of the rocker; and a spring in the cavity engaging the pivot bump, pressing the rocker laterally across the slot with the rocker front arm bearing on the strip of the board received in the slot, and pressing the wire received in the hole against the rocker rear arm.

2. The electrical connector defined in claim 1 wherein the rocker front arm is substantially longer than the rocker rear arm.

3. The electrical connector defined in claim 1 wherein the rocker rear end is bent down and the housing is formed with an abutment aligned with the hole and engageable with the rocker rear end.

4. The electrical connector defined in claim 1 wherein the housing is dielectric and the spring is wholly contained in the cavity, the rocker being contained in the cavity except for an outer end of its front arm.

5. The electrical connector defined in claim 1 wherein the housing has one face formed with mounting studs and an opposite face formed with complementary seats, whereby a plurality of the connectors can be ganged together with the studs of one housing engages in the seats of an adjacent housing.

6. The electrical connector defined in claim 1 wherein the housing is formed with a second hole offset from the first-mentioned hole and at which the spring is exposed, whereby a tool can be inserted in the second hole to displace the spring away from the rocker rear arm.

7. The electrical connector defined in claim 1, further comprising a lever engaging the spring and pivotal on the housing between a position pressing the spring away from the wire received in the hole.

8. The electrical connector defined in claim 1 wherein the spring has one end bearing against the rocker at the pivot and an opposite other end engageable with the rocker rear arm.

9. The electrical connector defined in claim 8 wherein the other spring end is formed with a hole through which the rocker rear arm engages.

10. The electrical connector defined in claim 9 wherein the hole in the other spring end is aligned with the housing hole.

11. The electrical connector defined in claim 9 wherein the housing is formed in the cavity with a pivot pin engaging the spring between its ends.

12. The electrical connector defined in claim 11 wherein the spring is a leaf spring looped around the pivot pin.

13. The electrical connector defined in claim 12 wherein the spring has its one spring end bearing on the pivot bump and its other spring end biased toward the rocker rear arm.

14. The electrical connector defined in claim 1 wherein the rocker is stiff and made of a conductive metal.

15. The electrical connector defined in claim 14 wherein the metal is brass.

* * * * *